US011647859B2

(12) United States Patent
Chapman, Jr.

(10) Patent No.: US 11,647,859 B2
(45) Date of Patent: May 16, 2023

(54) TUBE HOLDER AND ASSEMBLY

(71) Applicant: Robert C. Chapman, Jr., Lac du Flambeau, WI (US)

(72) Inventor: Robert C. Chapman, Jr., Lac du Flambeau, WI (US)

(73) Assignee: Robert C. Chapman, Jr., Lac du Flambeau, WI (US)

( * ) Notice: Subject to any disclaimer, the term of this patent is extended or adjusted under 35 U.S.C. 154(b) by 0 days.

(21) Appl. No.: 17/524,008

(22) Filed: Nov. 11, 2021

(65) Prior Publication Data

US 2022/0061574 A1 Mar. 3, 2022

Related U.S. Application Data

(63) Continuation-in-part of application No. 16/657,838, filed on Oct. 18, 2019, now abandoned.

(51) Int. Cl.
*A47G 33/12* (2006.01)
*A47G 33/06* (2006.01)

(52) U.S. Cl.
CPC ..... *A47G 33/12* (2013.01); *A47G 33/06* (2013.01); *A47G 2033/1273* (2013.01)

(58) Field of Classification Search
CPC ..... A47G 33/12; A47G 33/06; A47G 2033/1273; B65D 85/54; B65D 5/526; A63B 55/53; A63B 55/57; A63B 55/00; B65B 67/12; B65F 1/1468; B65F 1/141; E04G 25/04; E04G 25/06; F16B 7/105
USPC ..... 248/354.1, 354, 6, 95, 96, 97, 98, 528, 248/532, 533
See application file for complete search history.

(56) References Cited

U.S. PATENT DOCUMENTS 2,736,564 A * 2/1956 Loam ..... B62B 5/026 280/DIG. 10
3,995,881 A * 12/1976 Kruchell ..... B62B 5/085 280/646
4,062,564 A * 12/1977 Schimmeyer ..... B62B 5/085 280/DIG. 6

(Continued)

FOREIGN PATENT DOCUMENTS

DE 202004001171 5/2004
WO 2003059132 7/2003

OTHER PUBLICATIONS

Frontgate, Adjustable Storage Bag with Rolling Stand for 6-9' Christmas Tree, Accessed Jul. 18, 2018, https://www.frontgate.com/adjustable-storage-bag-with-rolling-stand-for-6-9-christmas-tree/810481.

*Primary Examiner* — Anita M King
(74) *Attorney, Agent, or Firm* — Andrus Intellectual Property Law LLC

(57) ABSTRACT

A system comprises a tube having an inner diameter that is dimensioned to receive an artificial Christmas tree within the tube, the tree having upwardly collapsible branches. The tube is open at a first end and at a second end. An axle may couple to the tube, and a plurality of wheels may couple to the axle. The wheels may be tri-lobe wheels. A securement strap structure is located at the second end and is perpendicular to the second end of the tube to secure the second end of the tube and the base structure of the artificial tree. The system can position the tube at an angle relative to the horizontal to insert the tree within the tube. The system can also position the tube horizontally to extract the tree from the tube.

12 Claims, 8 Drawing Sheets

(56) References Cited

U.S. PATENT DOCUMENTS 4,570,958 A * 2/1986 Walker ..... B62B 1/12 280/47.131
4,676,464 A 6/1987 Reimers
4,778,136 A 10/1988 Reimers
4,898,352 A 2/1990 Hoffman
5,351,921 A 10/1994 Chen
5,652,032 A 7/1997 Kaczor
5,765,614 A * 6/1998 Kardosh ..... B65F 1/1415 141/390
6,390,295 B2 5/2002 Rhee
6,460,867 B2 * 10/2002 Sciulli ..... A63B 55/57 280/DIG. 6
6,663,119 B2 * 12/2003 White ..... B62B 1/14 280/47.131
6,672,600 B2 1/2004 Engelhardt
7,419,037 B2 * 9/2008 Nordstrom ..... A45C 13/262 280/37
7,694,494 B2 * 4/2010 Bornemeier ..... A47G 33/045 53/396
8,075,185 B2 * 12/2011 Hecht ..... A47G 33/045 280/18
8,820,497 B1 * 9/2014 Goldsmith ..... A45C 5/14 190/18 A
9,586,109 B2 3/2017 Martell et al.
10,413,107 B1 * 9/2019 Cohen ..... A47G 33/045
2003/0209549 A1 * 11/2003 Grimes ..... B65F 1/06 220/495.08
2005/0211589 A1 * 9/2005 Holzhaus, II ..... B65D 85/52 206/423
2006/0267301 A1 11/2006 Tuntland
2010/0213090 A1 * 8/2010 Bebrin ..... B65D 85/54 53/473
2016/0113427 A1 4/2016 Hendricks
2017/0253405 A1 9/2017 Limber
2020/0048426 A1 * 2/2020 Kossoy ..... C01G 41/00

* cited by examiner

TUBE HOLDER AND ASSEMBLY

PRIORITY

This application is a continuation-in-part of U.S. application Ser. No. 16/657,838 filed Oct. 18, 2019.

BACKGROUND

Artificial Christmas trees have increased in popularity due to their ease of use and longevity. Due to their ability to be reused, many users of artificial trees put them up around the holidays and keep them in storage for the remainder of the year. Often, storing artificial trees involves disassembling the tree, either in part or entirely, necessitating reassembly whenever the tree is re-erected.

DETAILED DESCRIPTION

Artificial Christmas trees are used in many homes due to their convenience, their ease of use, and the fact that they are able to be reused for multiple years. An artificial Christmas tree is able to be erected and decorated for the holidays and stored for the remainder of the year. With proper care and storage, an artificial Christmas tree can last many years.

Many artificial Christmas trees are comprised of several pieces that, when assembled, form a traditional tree shape. The pieces may, for example, comprise a set of central poles with branches extending therefrom; the poles may be coupled to one another in lengthwise fashion to create the tree. In some examples, the tree may further include a stand to hold and support the tree, which may be coupled to the base of the lowermost central pole. When disassembling a tree, the central poles may be decoupled from one another and, in some examples, the stand may be removed. The pieces may then be placed into a storage container.

The tube holder of the present disclosure, by contrast, is designed to hold a fully assembled artificial Christmas tree, including an attached stand. The holder may comprise a tube with a uniform diameter for the length of the tube or with a first diameter and a second diameter. Rivets at both an upper portion and a lower portion of the tube may provide additional strength at the points along the tube holder where they are disposed. Preferably, however, the tube and certain of its integral features as will be described herein is molded as a unitary structure by means of rotational plastic molding.

Significantly, at least one securement strap is included at the bottom of the tube to fasten and secure the otherwise open bottom of the tube. For additional ease of movement and transportation, wheels are included as part of the tube holder as well.

Due to its design and construction, the tube holder of the present disclosure may be able to receive an assembled artificial Christmas tree, including a stand. Said differently, the tube holder of the present disclosure does not require an artificial Christmas tree to be disassembled for storage. This reduces the time and effort to both store the Christmas tree and reassemble it for the next holiday season. Additionally, by removing the step of disassembly, the pieces and other components of the artificial Christmas tree stay together; since pieces are together, the likelihood of pieces getting lost or damaged is reduced and even eliminated. In the system of the preferred embodiment, the artificial Christmas tree has a plurality of upwardly-rotatable tree branches such that the tree branches can be urged upwardly, or collapsed, along the central pole of the tree. This allows the diameter of the tree to be compacted from its normal display diameter such that, when the branches are collapsed, the tree can more easily received by and fit within the tube, as will be described in greater detail herein.

Figure 1:
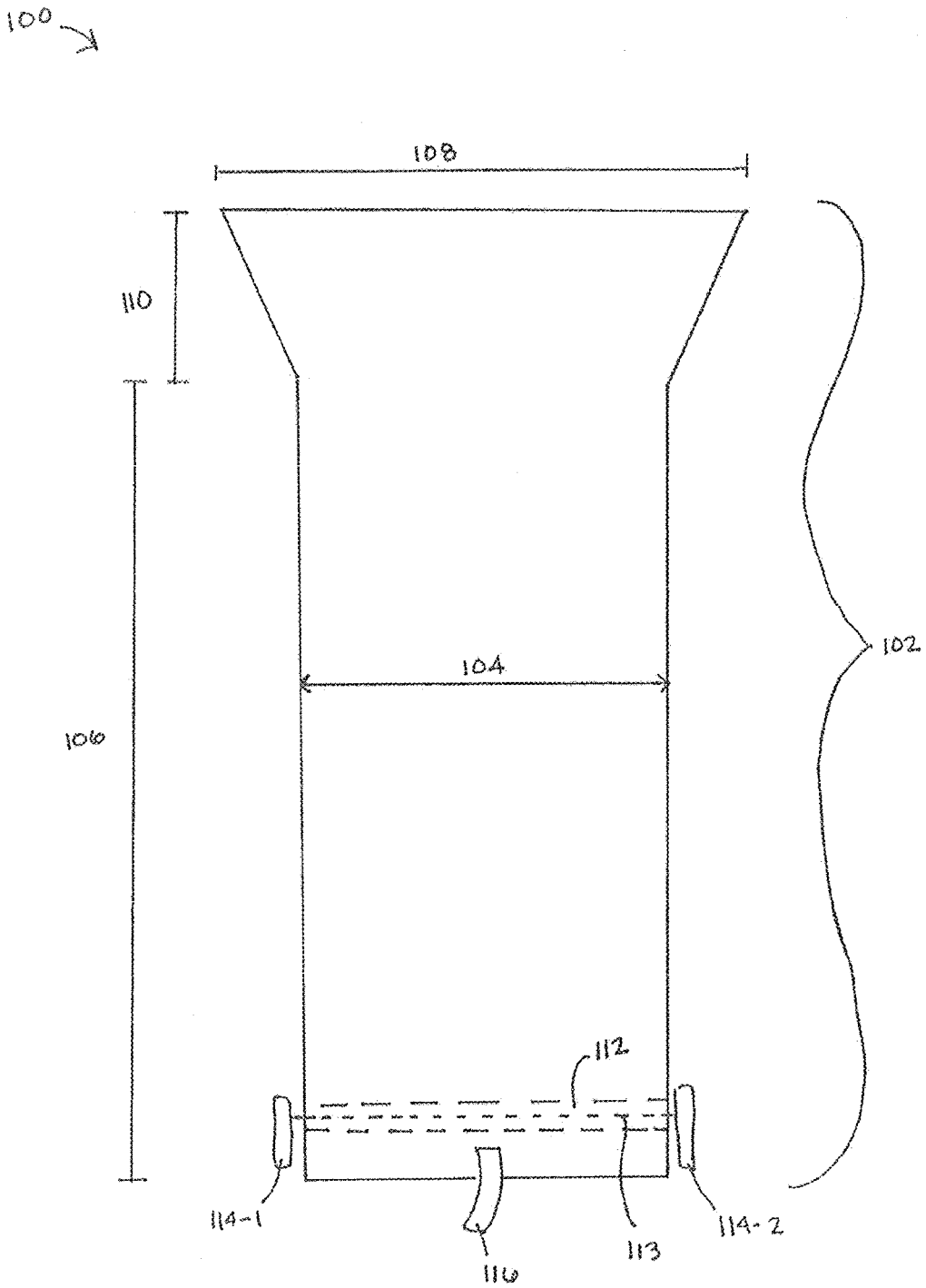
FIG. 1 is an example of a tube holder consistent with the present disclosure.

FIG. 1 is an example of a tube holder 100 consistent with the present disclosure. Tube holder 100, which may be referred to alternately as apparatus 100, comprises a tube 102. Tube 102 may be open at both ends, i.e., not be a closed tube.

Tube 102 may have a first diameter 104 disposed along a first length 106 of the tube 102. The first diameter 104 may be between 18 inches and 24 inches, although examples are not so limited, and any diameter may be used. A second diameter 108 may be disposed along a second length 110 of the tube 102. As shown in FIG. 1, the second diameter 108 may be greater than the first diameter 104. The second diameter 108 may be between 20 inches and 26 inches, although examples are not so limited. The second length 110 of tube 102 may be disposed above first length 106 of tube 102, as shown in FIG. 1, such that second diameter 108 is above first diameter 104. In some examples, the second diameter 108 may decrease, or taper, throughout the second length 110 of tube 102, allowing the second length 110 of tube 102 to smoothly connect with the first length 106 of tube 102.

Tube 102 may further include an integrally formed channel 112. As used herein, a channel refers to a pathway or conduit through which something is able to be passed. Channel 112 may be formed as part of tube 102 and may be disposed at a lower end, i.e., oppose the second length, of tube 102. Channel 112 may extend through the diameter 104 of the tube 102 and may be sized to receive an axle, such as axle 113.

A plurality of wheels 114-1, 114-2 may be disposed at the lower portion of the tube 102. Wheels 114-1 and 114-2 may be coupled to axle 113, which may then be disposed through channel 112. As shown in FIG. 1, wheels 114-1 and 114-2 may be oriented such that they are substantially perpendicular to tube 102. This may allow tube 102 to be moved via wheels 114-1 and 114-2.

Apparatus 100 may further include a securement strap 116. As used herein, a securement strap refers to a strap able to be selectively engaged to close or otherwise secure a location. Securement strap 116 may be located at the lower portion of tube 102, and may be in a similar location as wheels 114. The securement strap 116 may further be disposed perpendicular to the second, lower end of the tube 102. A first end of securement strap 116 may be permanently coupled to tube 102, while a second end of securement strap 116 may be removably coupled to the tube 102. Securement strap 116 may be used to secure the second end of the tube 102. Securement strap 116 may be made of nylon, canvas, or another similar material, and may be removably coupled to the tube 102 via the use of hook and loop fasteners or snaps. However, examples are not so limited and any material and/or fastener may be used.

Figure 2:
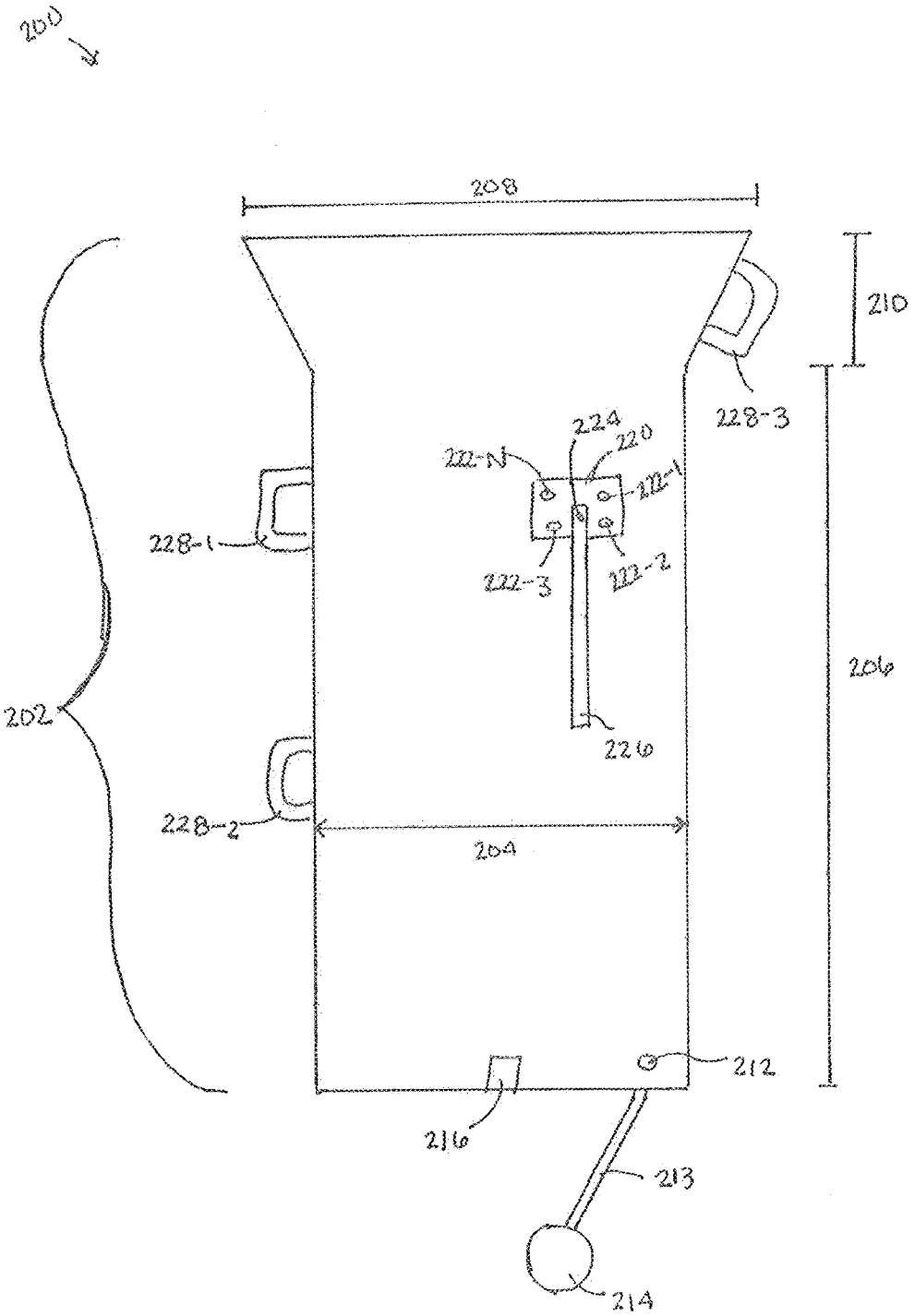
FIG. 2 is another example of a tube holder consistent with the present disclosure.

FIG. 2 is another example of a tube holder 200 consistent with the present disclosure. Tube holder 200, also referred to as apparatus 200, may include a tube 202. Tube 202 may be akin to tube 102, discussed previously with respect to FIG. 1. Tube 202 may have a first diameter 204 disposed about a first length 206 thereof, and a second diameter 208 disposed about a second length 210. A plurality of wheels 214 may be coupled to the tube 202 at an axle 213. A single wheel 214 is shown in FIG. 2; the other wheel 214 would be disposed opposite. The axle 213 may be coupled to the tube 202 through an integrally formed channel 212. Further, a securement strap 216 may be located at the lower portion of tube 202 and may be in a similar location as wheels 214. Securement strap 216 may be akin to securement strap 116, described previously with respect to FIG. 1.

A plate 220 may be coupled to tube 202 at an upper portion thereof. Plate 220 may be made of metal, plastic, or another durable and rigid material, and may be coupled to the tube 202 by a plurality of fasteners 222-1, 222-2, 222-3 . . . 222-N. Fasteners 222-1, 222-2, 222-3 . . . 222-N may be rivets, nails, screws, adhesive strips, or any other type of fastener that would bond plate 220 to tube 202. Although four fasteners are shown in FIG. 2, examples are not so limited and other numbers of fasteners may be used.

A peg 224 may extend from plate 220. As used herein, a peg refers to a short, often cylindrical piece of material that is used to join pieces or to hang a piece off of. Peg 224 may be integrally formed with plate 220 or may be a separate piece that is coupled to plate 220, and may extend substantially perpendicularly from the face of plate 220.

A support leg 226 may be coupled to the plate 220. In some examples, support leg 226 may be coupled to the plate 220 at peg 224. In such examples, support leg 226 may be rotatable with respect to peg 224 and plate 220. That is, support leg 226 may be rotated into a variety of positions, based on the desire of a user. In some examples, support leg 226 may be coupled to peg 224 by a friction fit; however, in other examples, a nut or other piece may be coupled to the peg 224 upon the coupling of the support leg 226 such that support leg 226 is prevented from inadvertently sliding off the end of peg 224.

A plurality of handles 228-1, 228-2, 228-3 may be coupled to tube 202. Although three handles are shown in FIG. 2, examples are not so limited and more or fewer handles may be used. In addition, handles 228-1, 228-2, 228-3 are not limited to the locations shown in FIG. 2 but may be disposed an any location on tube 202. Handles 228-1, 228-2, 228-3 may be made of plastic, metal, or another suitably durable and hard material and may be coupled to tube 202 by rivets, nails, screws, glue, or any other fastening means. In some examples, handles 228-1, 228-2, 228-3 may be integrally formed as part of tube 202. Said differently, handles 228-1, 228-2, 228-3 may be molded as part of tube 202, rather than as separate pieces. In such examples, handles 228-1, 228-2, 228-3 may not use an additional fastener to attach to tube 202. Handles 228-1, 228-2, 228-3 may be disposed such that a user of apparatus 200 is able to tip or otherwise move apparatus 200. For example, handle 228-3, as shown in FIG. 2, may be used to tip tube 202 back with respect to wheels 214, allowing easier access to the opening at the top of tube 202.

Figure 3:
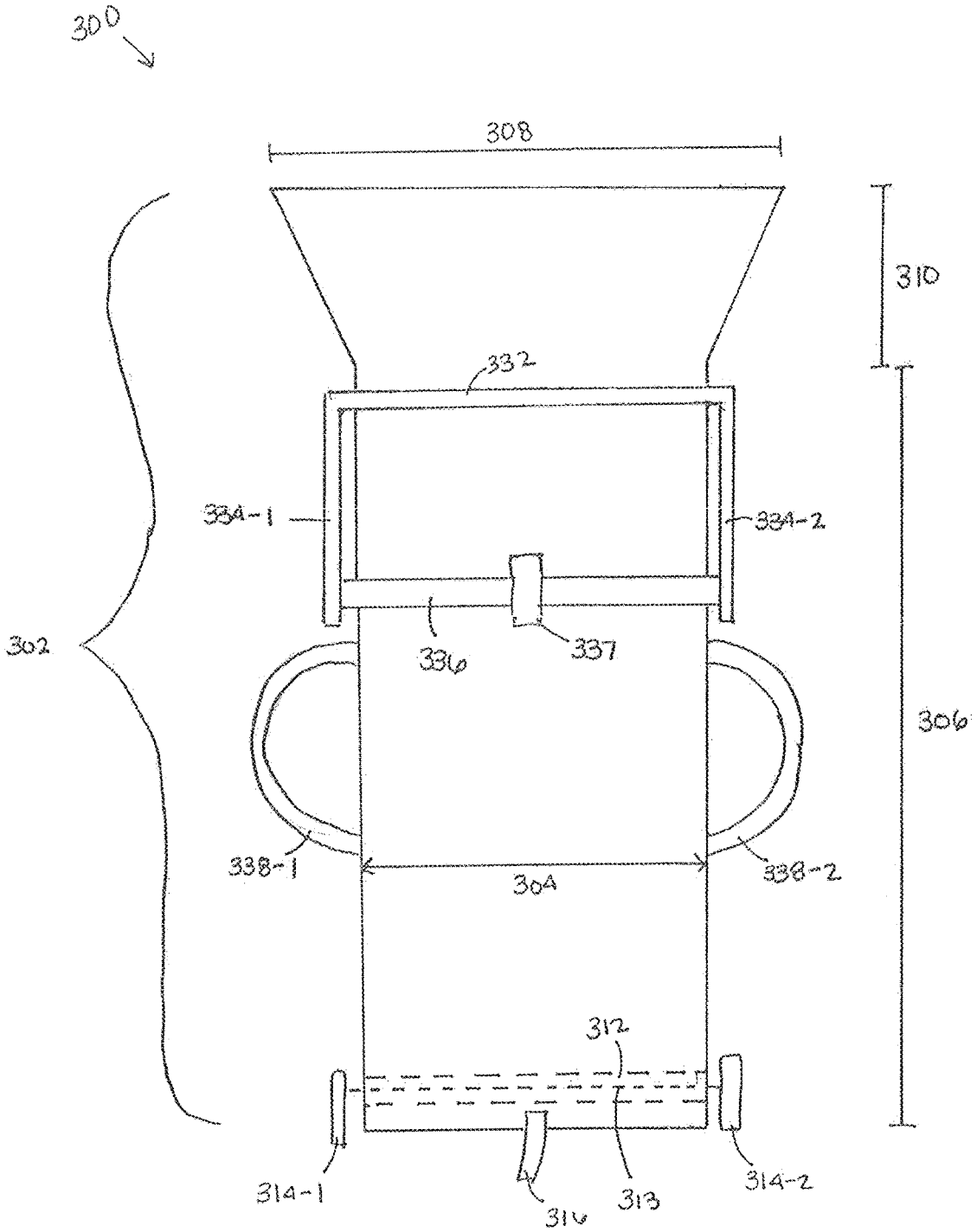
FIG. 3 is another example of a tube holder consistent with the present disclosure.

FIG. 3 is another example of a tube holder 300 consistent with the present disclosure. Tube holder 300 may also be referred to as apparatus 300 and may include a tube 302. Tube 302 may be akin to tubes 102 and 202, discussed with respect to FIGS. 1 and 2, respectively. Tube 302 may have a first diameter 304 disposed about a first length 306. A second diameter 308 may be disposed about a second length 310. A plurality of wheels 314-1, 314-2 may be coupled to the tube 302. In some examples, wheels 314-1, 314-2 may be coupled to tube 302 by an axle 313. Axle 313 may be coupled to tube 302 by an integrally formed channel 312. In addition, a securement strap 316 may be located at the lower portion of tube. Securement strap 316 may be akin to securement straps 116, 216, described previously with respect to FIGS. 1 and 2.

Apparatus 300 may further include a bar 332, which may be disposed perpendicular to the length of the tube 302. The bar 332 may be coupled to the tube by, for example, rivets, screws, nails, glue, or another fastening material. In some examples, the length of the bar 332 may be greater than second diameter 308 of tube 302, such that a portion of bar 332 extends beyond tube 302 on one or both ends of the tube 302.

A pair of legs 334-1, 334-2 may be coupled to the bar 332. In some examples, one leg 334-1, 334-2 may be coupled to each end of bar 332; that is, legs 334-1, 334-2 may be disposed parallel to one another with bar 332 disposed between them. Legs 334-1, 334-2 may be rotatably coupled to bar 332 by, for example, a hinge, or a ball joint, although examples are not so limited. As a result, legs 334-1, 334-2 may rotate with respect to bar 332. In some examples, legs 334-1, 334-2 may rotate outwardly with respect to bar 332, and thus with respect to tube 302. In such examples, legs 334-1, 334-2 may be rested upon a floor or other surface to support tube 302.

A crosspiece 336 may be disposed between legs 334-1, 334-2. Crosspiece 336 may be permanently coupled to legs 334-1, 334-2 by, for example, glue or a weld joint, or may be removably coupled to legs 334-1, 334-2 by a screw or similarly removable joiner. As shown in FIG. 3, crosspiece 336 may be disposed toward a lower end of legs 334-1, 334-2. As a result, crosspiece 336 may serve to provide additional stability and strength to legs 334-1, 334-2, particularly when legs 334-1, 334-2 are rotated away from tube 302 and resting on a floor or similar surface.

A securement mechanism 337 may be coupled to the tube 302. As used herein, a securement mechanism refers to a device or mechanism able to be selectively engaged to secure a movable piece, such as crosspiece 336. Securement mechanism 337 may be a hook and loop fastener, a fabric fastener secured by snaps, or any other securement mechanism. Securement mechanism 337 may be disposed such that crosspiece 336 is able to be secured to tube 302. In some examples, the securement mechanism 337 may be engaged to prevent legs 334 from rotating with respect to bar 332 by preventing crosspiece 336 (which is coupled to legs 334-1, 334-2) from moving.

A plurality of straps 338-1, 338-2 may be disposed along the sides of the tube 302. As used herein, a strap refers to a piece or strip of material used to carry or hold something. Straps 338-1, 338-2 may be disposed along the sides of tube 302 such that a user is able to carry tube 302 by straps 338-1, 338-2. In some examples, the straps 338-1, 338-2 may be manufactured of leather, nylon webbing, canvas, or a similar fabric; however, examples are not so limited and other materials may be used. Straps 338-1, 338-2 may couple to tube 302 by rivets, screws, or another fastening mechanism, and may be removable or may be permanently attached.

Figure 4:
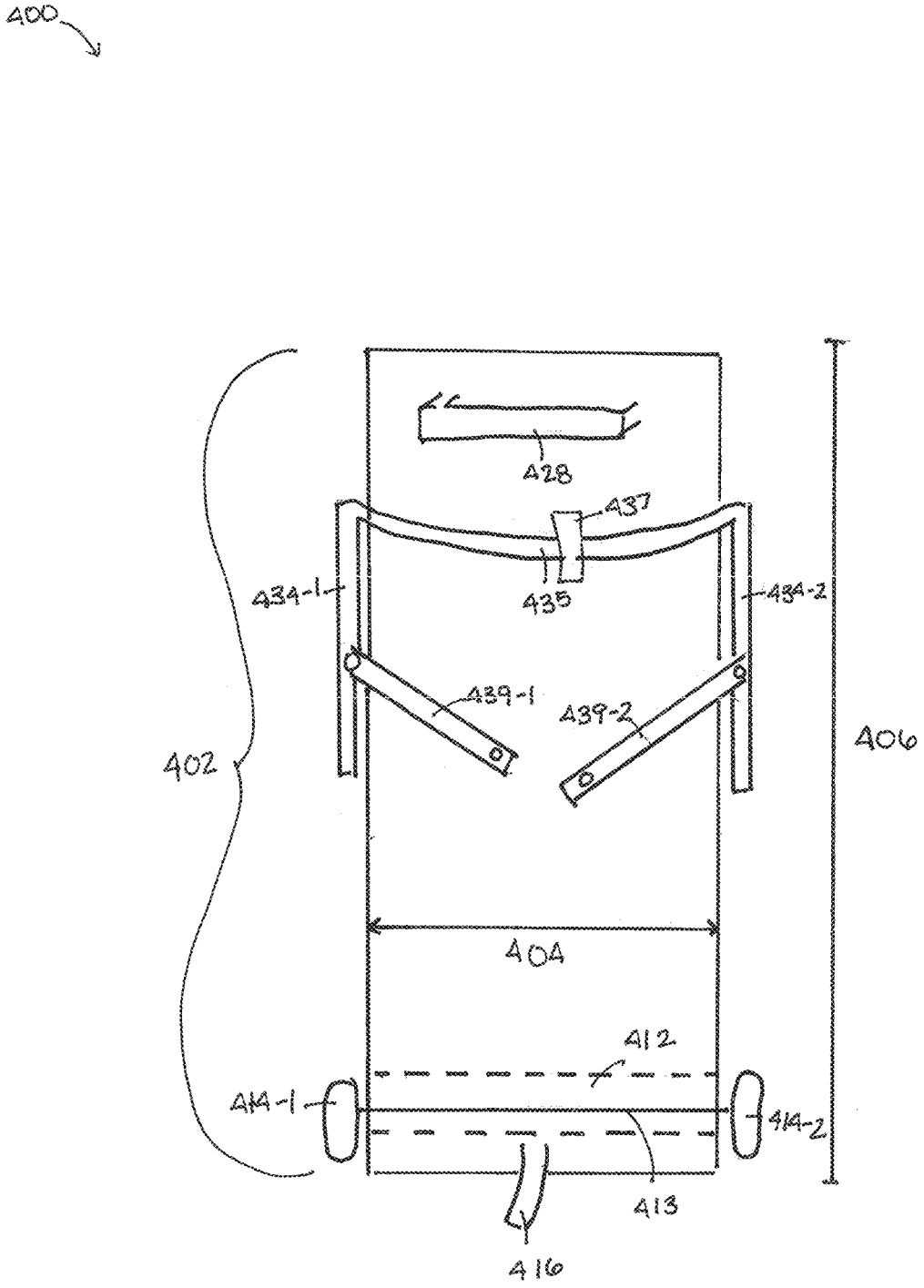
FIG. 4 is another example of a tube holder consistent with the present disclosure.

FIG. 4 is another example of a tube holder 400 consistent with the present disclosure. Tube holder 400 may also be referred to as apparatus 400 and may include a tube 402. Tube 402 may be akin to tubes 102, 202, and 302, discussed with respect to FIGS. 1-3, respectively. Tube 402 may have a first diameter 404 disposed about a first length 406. Unlike tubes 102, 202, 302, discussed with respect to FIGS. 103, tube 402 may have a single diameter 404; that is, tube 402 may lack an upper portion having a second length and second diameter. A plurality of wheels 414-1, 414-2 may be coupled to the tube 402. In some examples, wheels 414-1, 414-2 may be coupled to tube 402 by an axle 413. Axle 413 may be coupled to tube 402 by an integrally formed channel 412. In addition, a securement strap 416 may be located at the lower portion of tube 402. Securement strap 416 may be akin to securement straps 116, 216, and 316, described previously with respect to FIGS. 1-3.

Tube 402 may include a plurality of legs 434-1, 434-2 coupled to a crosspiece 435. Legs 434-1, 434-2 may be akin to legs 334-1, 334-2, discussed with respect to FIG. 3, and may be disposed such that the legs 434-1, 434-2 are parallel to the tube 402 when not extended.

Crosspiece 435 may be disposed between legs 434-1, 434-2, with legs 434-1, 434-2 being attached thereto. Crosspiece 435 may be curved, or be substantially U-shaped, as shown in FIG. 4, or may be straight. In some examples, crosspiece 435 may be coupled to the tube 402 such that crosspiece 435 is rotatable with respect to the tube 402. That is, crosspiece 435 may be coupled to tube 402 such that the crosspiece 435, and thus legs 434-1, 434-2, are able to rotate outwardly, away from the tube 402, to allow tube 402 to be supported by a floor surface. This may be used, for example, when placing an artificial tree into or removing an artificial tree from tube 402.

Crosspiece 435 may be selectively secured to tube 402 by a securement mechanism 437. Securement mechanism 437 may be akin to securement mechanism 337, discussed with respect to FIG. 3. As with securement mechanism 337, securement mechanism 437 may be a hook and loop fastener, a fabric fastener secured by snaps, or any other securement mechanism such that crosspiece 435 is able to be secured to, and thus prevented from rotating with respect to, the tube 402.

A pair of straps 439-1, 439-2 may be coupled to legs 434 and to tube 402. Straps 439-1, 439-2 may provide additional resistance and stability to legs 434-1, 434-2 when legs 434-1, 434-2 are extended (i.e., rotated away from the tube 402), but may be made of a flexible material, such as canvas or nylon, such that straps 439-1, 439-2 are able to "fold" back when legs 434-1, 434-2 are rotated into a rest position (i.e., when legs 434-1, 434-2 are not being used as a stand for tube 402). Straps 439-1, 439-2 may be attached at one end to a leg of legs 434-1, 434-2 by, for example, a rivet, glue, or other suitable bonding agent. Similarly, straps 439-1, 439-2 may be attached at the opposite end to the body of tube 402, again using a rivet, glue, or any other suitable bonding agent.

A handle 428 may further be coupled to tube 402. Handle 428 may be akin to handles 228, discussed with respect to FIG. 2, in that handle 428 may facilitate tipping or moving apparatus 400. Although only one handle is shown in FIG. 4, examples are not so limited, and any number of handles may be used. In addition, the location of handle 428 is not limited to the location shown in FIG. 4; handle 428 may be located at any point on apparatus 400. Handle 428 may be made of metal, plastic, wood, or any other suitable material, and may be coupled to tube 402 by rivets, nails, screws, integral formation, or any other attachment means.

Figure 5:
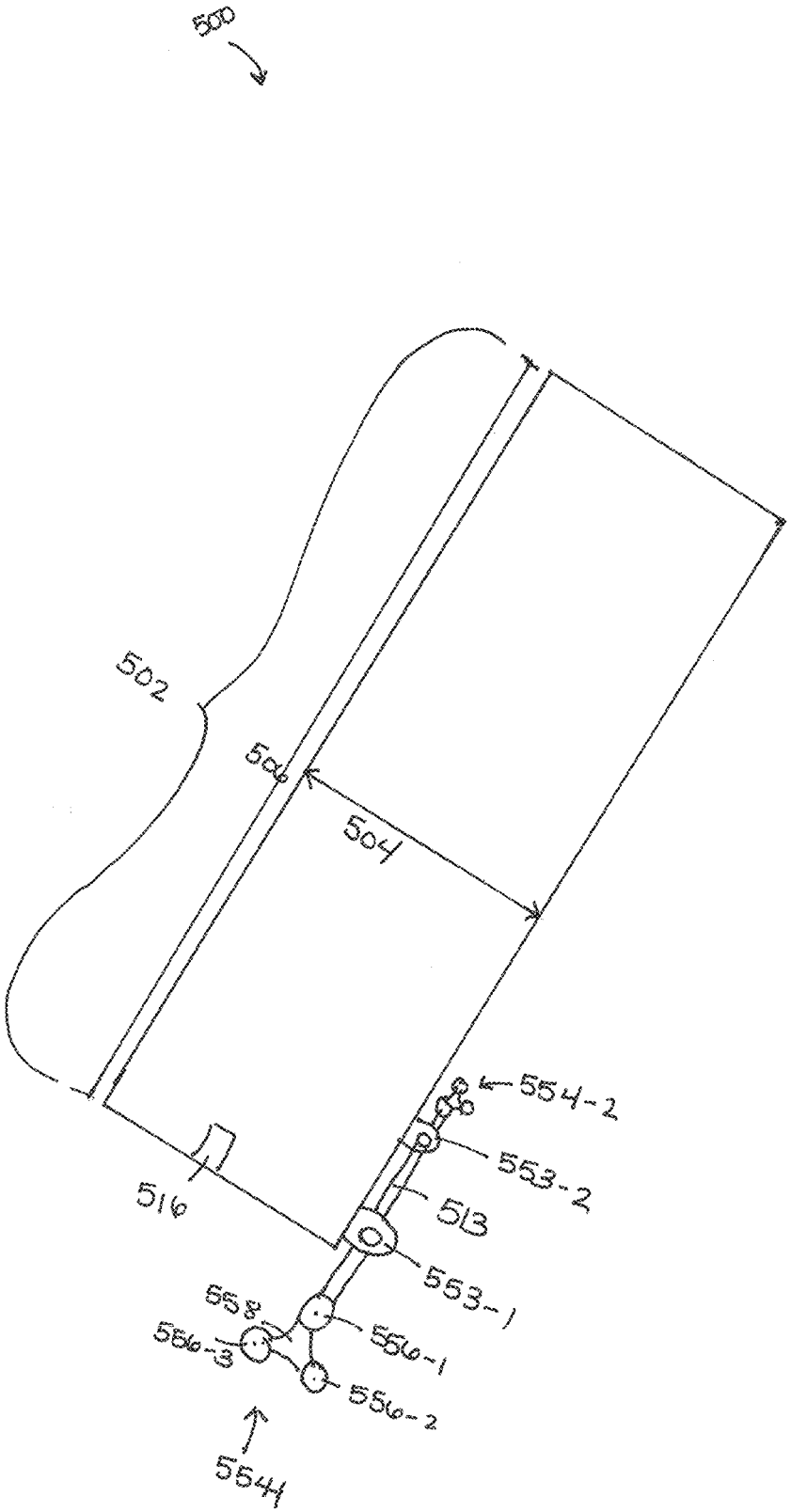
FIG. 5 is another example of a tube holder consistent with the present disclosure.

FIG. 5 is another example of a tube holder 500 consistent with the present disclosure. Tube holder 500 may also be referred to as apparatus 500 and may include a tube 502. Tube 502 may be akin to tubes 102, 202, 302, and 402, discussed with respect to FIGS. 1-4, respectively, and may have a first diameter 504 disposed about a first length 506. Like tube 402, tube 502 may have a single diameter 504 throughout length 506, with no upper portion having a second length and a second diameter. A securement strap 516 may be located at the lower portion of tube 502. Securement strap 516 may be akin to securement straps 116, 216, 316, and 416, described previously with respect to FIGS. 1-4.

A plurality of protrusions 553-1, 553-2 may be disposed at a lower end of tube 502. As used herein, a protrusion refers to a piece or object that protrudes or extends from another object. Protrusions 553-1, 553-2 may extend from tube 502 and may extend so as to be substantially perpendicular with respect to the tube 502. Protrusions 553-1, 553-2 may be integrally formed as part of tube 502 by, e.g., being molded as part of tube 502, or may be attached to the tube 502 by, for example, rivets, nails, glue, or any other fastening material.

Each protrusion of protrusions 553-1, 553-2 may include a hole disposed therein. The hole may be sized to receive an axle 513. Axle 513 may be akin to axle 113, 213, 313, 413, discussed with respect to FIGS. 1-4; however, as shown in FIG. 5, axle 513 may be received through protrusions 553 and not through an integrally formed channel within tube 502. In this manner, axle 513 may be disposed external to the body of tube 502; that is, axle 513 may be situated outside of tube 502.

A plurality of wheels may be coupled to the axle 513. The wheels may be circular wheels such as wheels 114, 214, 314, 414, discussed with respect to FIGS. 1-4, or may be tri-lobe wheels 554-1, 554-2. Tri-lobe wheels 554-1, 554-2 is comprised of a set of three circular wheels 556-1, 556-2, 556-3. Circular wheels 556-1, 556-2, 556-3 are coupled to a hub portion 558. As shown in FIG. 5, hub portion 558 is substantially triangular in shape, allowing circular wheels 556-1, 556-2, 556-3 to be disposed in a triangle. This may assist in moving apparatus 500 over rough or bumpy surfaces, or may allow the apparatus 500 to be moved up and down stairs. Hub portion 558 is coupled to an axle, such as axle 513.

Figure 6:
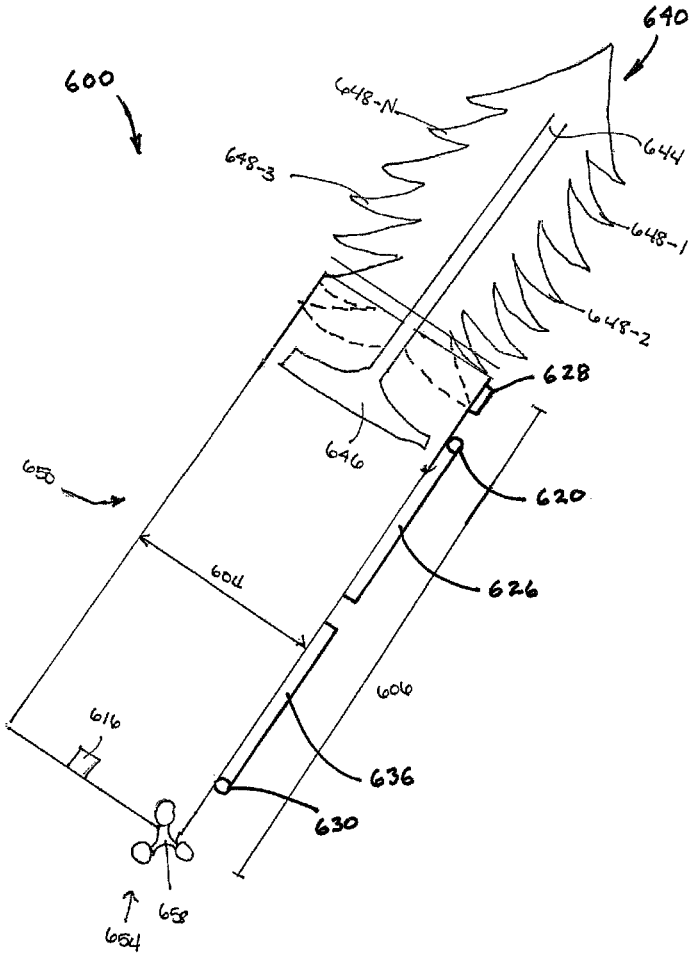
FIG. 6 is an example system including a tube holder and an artificial Christmas tree consistent with the present disclosure.

FIG. 6 is an example system 600 including a tube holder assembly 650 consistent with the present disclosure. The system 600 also includes an artificial tree 640. Artificial tree 640 may be an artificial Christmas tree or another variety of artificial tree. Artificial tree 640 may include a central pole 644 and a stand 646 disposed at the end of the central pole 644. The central pole 644 may extend upwardly from the stand 646 and may be perpendicular to the stand 646.

Extending outwardly from the central pole 644 may be a plurality of branches 648-1, 648-2, 648-3 . . . 648-N. Branches 648-1, 648-2, 648-3 . . . 648-N may be comprised of a central rod, which may be metal, plastic, or another rigid or semi-rigid material. Needles, made of plastic or a similar material, may extend outwardly from the central rod, giving branches 648-1, 648-2, 648-3 . . . 648-N an appearance similar to that of a natural fir tree. Branches 648-1, 648-2, 648-3 . . . 648-N may extend from central pole 644 at an angle or may extend in a substantially perpendicular direction. In some examples, branches 648-1, 648-2, 648-3 . . . 648-N may be movable with respect to central pole 644; that is, branches 648-1, 648-2, 648-3 . . . 648-N may be moved into a variety of positions with respect to the central pole 644.

Stand 646 may be disposed at an end of central pole 644. Stand 646 may be manufactured of metal, plastic, or a similar rigid material. In some examples, stand 646 may be removable with respect to central pole 644. That is, stand 646 may be selectively engaged and disengaged with the central pole 644 by, for example, screwing the stand 646 onto or off of the central pole 644. In other examples, stand 646 may be permanently coupled to the lower end of central pole 644 such that stand 646 is not removable without breaking. Stand 646 can also be a collapsible structure whereby support legs are provided whereby the support legs can be deployed and locked into place for stabilization of the tree 640 when the tree 640 is in use. In the preferred embodiment, the legs of the stand 646 are upwardly collapsible. With this configuration, and when the tree 640 is ready for storage, the legs of the stand 646 can be collapsed upwardly from a central base that is common to each of the legs that extend away from it. This central base is that part of the tree 640 that prevents the tree 640 from slipping through securement straps 616 as described below.

Tube holder assembly 650 further includes a tubular body 652. Body 652 has a diameter 604 that remains substantially the same along the entire length 606 of the body 652. In general, the body length 606 corresponds with the height of the artificial tree 640. That is, tubular body 652 may be sized to receive and hold the entire artificial tree 640. A lower end 653 of the body 652 may be open; that is, body 652 may not have a sealed lower end 653. Tubular body 652 further comprises an upper end or portion 651.

A securement strap 616 may be coupled to the body 652 at the lower end or portion 653. As described previously, the lower end 653 of body 652 may be open; thus, securement strap 616 may be provided to aid in preventing an object, such as artificial tree 640 from accidentally falling out of the tubular body 652. As described with respect to FIG. 1, a first end of securement strap 616 may be permanently coupled to body 652, while a second end of securement strap 616 may be removably coupled to the body 652.

Disposed at the lower end or portion 653 of body 652 may be a plurality of wheels. The wheels may be circular wheels such as wheels 114, 214, 314, discussed with respect to FIGS. 1-3, or may be tri-lobe wheels 654. Tri-lobe wheels 654 may be akin to tri-lobe wheels 554, discussed with respect to FIG. 5. Although only a single tri-lobe wheel 654 is shown in FIG. 6, another tri-lobe wheel would be located opposite tri-lobe wheel 654 shown. The hub portion 658 of tri-lobe wheel 654 may be coupled to body 652 by an axle, such as axle 113, 213, 313, 414, discussed with respect to FIGS. 1-4 but not shown in FIGS. 6, 6A and 6B. The axle may further be engaged with an integrally formed channel 613 such as channel 112, 212, 213, 413, discussed with respect to FIGS. 1-4, or may be engaged with a protrusion 665 or a plurality of protrusions such as protrusions 553, discussed with respect to FIG. 5.

Figure 6A:
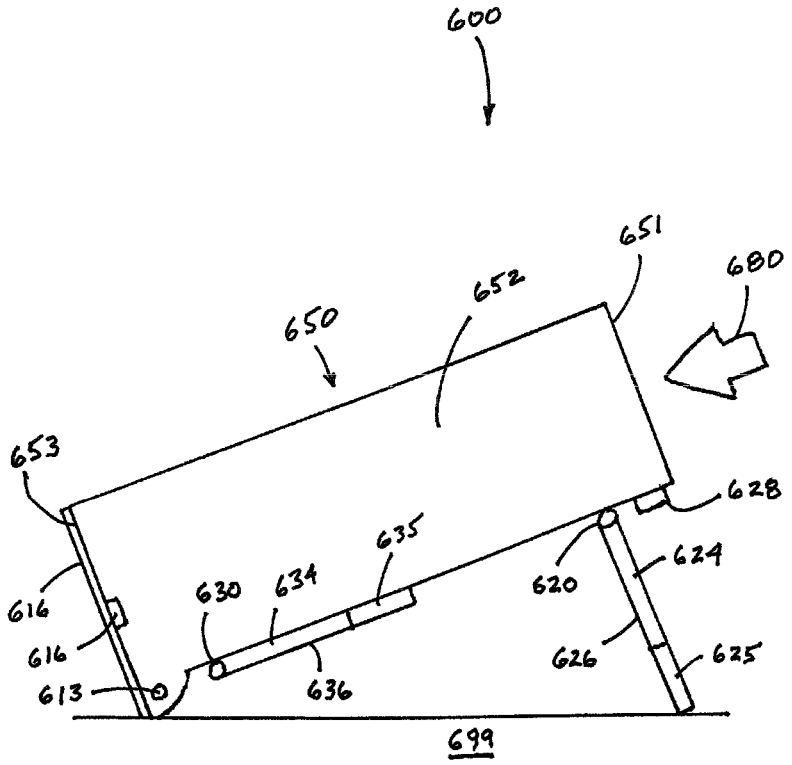
FIG. 6A illustrates positioning of the tube holder when the artificial Christmas tree is inserted into the tube holder consistent with the present disclosure.
Figure 6B:
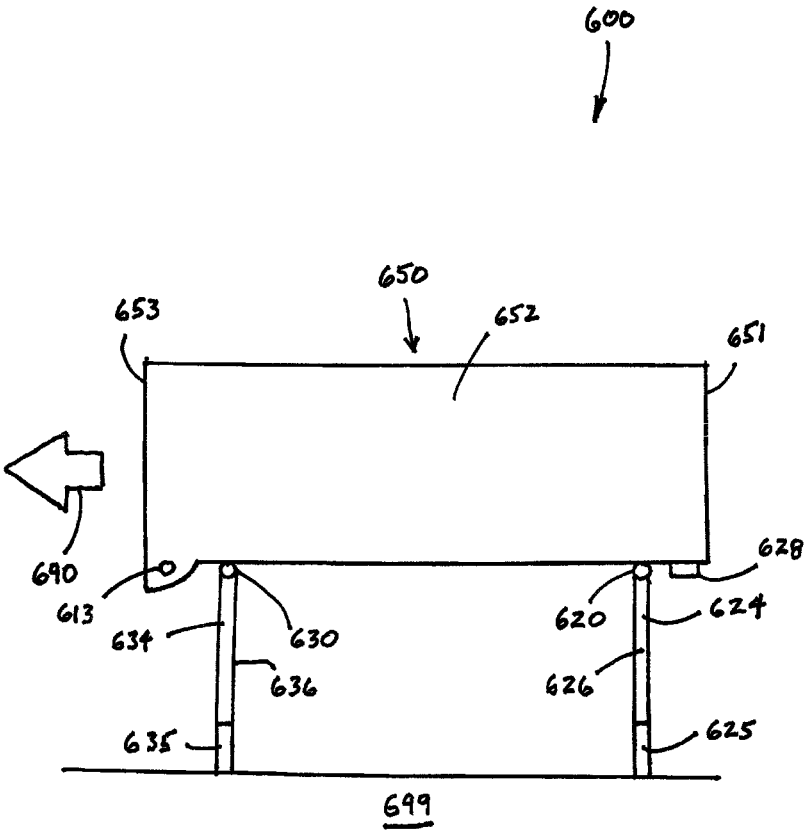
FIG. 6B illustrates positioning of the tube holder when the artificial Christmas tree is removed from the tube holder consistent with the present disclosure.

As shown in FIGS. 6A and 6B, the preferred embodiment of the system 600 is first illustrated where the body 652 is positioned at an acute angle relative to horizontal for tree insertion and that the body 652 is then illustrated to be positioned horizontally for tree removal, respectively. Although the tree 640 is not shown, a first arrow 680 is used in FIG. 6A as an indicator of tree insertion. One major benefit of positioning the tubular body 652 at an angle is that gravity can assist the user during the insertion step. Referring back to FIG. 6, the body 652 is shown to be presented at an angle relative to the horizontal, but the structure needed to place the body 652 in that position is not shown. Accordingly, this structure is more clearly shown in FIG. 6A.

Towards the top end of the body 652 is a first plate 620, the first plate 620 being secured to the body 652 at a point and providing a pivot point. Rotatably attached to the first plate 620 via the pivot point is a first leg 626. As shown, the first leg 626 comprises an upper leg portion 624 and a lower leg portion 625. The upper leg portion 624 is provided for support of the tube body 652. The lower leg portion 625 is provided to stabilize the upper leg portion 624. Most typically, the shape of the lower leg portion 625 is such that it provides at least two points of contact with the horizontal surface 699 that it sits on, such as a floor. Normal "collapsed" position of the first leg 626 (such as for storage) is where the leg 626 is parallel to the axis of the tube body 652 and immediately adjacent the outer surface of the tube body 652. As shown in FIG. 6A, the first leg 626 is in its "extended" position whereby the first leg 626 is presented substantially perpendicularly to the axis of the tube body 652. The first leg 626 can be retained in this extended position via a leg locking mechanism (not shown).

Toward the bottom end of the tube body 652, a second plate 630 is shown, the plate 630 likewise being secured to the tube body 652 at a point. Rotatably attached to the second plate 630 is a second leg 636. As shown in FIG. 6A, the second leg 636 comprises an upper leg portion 634 and a lower leg portion 635. Normal "storage" position of the second leg 636 is where the leg 636 is parallel to the axis of the tube body 652 and immediately adjacent the outer surface of the tube body 652. As shown in FIG. 6A, the second leg 636 is illustrated to be in that "collapsed" storage position. The bottom end 653 of the tube body 652 is supported by the tri-lobe wheels 654 of the type shown in FIG. 6. The bottom end 653 of the tube body 652 also includes the straps 616 for effectively closing off that end 653 of the tube body 652 and for supporting the tree stand once the tree is fully inserted. The straps 616 assume an X-shaped securement structure as previously described. In the position shown in FIG. 6A, the tube body 652 is ready for insertion of the tree.

The tree is inserted 680 stand-end first (the tree stand being in a collapsed position) and, as the individual branches engage the top end 651 of the tube body 652, each branch is gently urged upwardly so as to collapse the tree 640 into its storage position. Once the tree 640 is completely inserted, the tube body 652 can be placed upright on its bottom end 653 and the first leg 626 can be collapsed and held in that position via a fastener such as a hook-and-loop fastening structure. A dust cloth can be placed over the top end of the tube 652 and the tube 652, which is now the entire system 600, can be rolled to its storage location with the user using the handle 628 for navigating the system 600.

FIG. 6B shows the position of the tube body 652 when the has been retrieved by storage. The user would pull the handle 628 of the tube body 652 downwardly to allow the tube 652 to be rolled into a position near where the tree will be pulled from the tube body 652. To get to that position by pulling the system 600 or by navigating a stairway, the tri-lobe wheels 654 will be used to allow this relocation of the system 600. Once in position, the user can release the retaining straps holding the legs 626, 636 and move the legs

626, 636 from their storage or collapsed position to their respective extended positions such that the tube body 652 is now elevated and placed in a horizontal position. The legs 626, 636 are retained in their extended positions via a locking mechanism (not shown). Although the tree 640 is not shown, a second arrow 690 is used in FIG. 6B as an indicator of tree extraction by the user. Either during extraction or after full extraction, the foldable legs of the tree stand can be deployed. Once fully removed from the tube body 652, the user can place the tree in its final destination and its branches may be pulled downwardly by hand or by gravity, or a combination thereof, and depending on the tree.

The user can then secure the legs 626, 636 to their collapsed or storage position and the tube body 652 can be stowed away until it is time to retrieve it and re-insert the tree.

In the foregoing detailed description of the present disclosure, reference is made to the accompanying drawings that form a part hereof, and in which are shown by way of illustration how examples of the disclosure may be practiced. These examples are described in sufficient detail to enable those of ordinary skill in the art to practice the examples of this disclosure, and it is to be understood that other examples may be utilized and that process and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and relative scale of the elements provided in the figures are intended to illustrate the examples of the present disclosure and should not be taken in a limiting sense.

The invention claimed is:

1. A system, comprising:

a tube, wherein:

the tube has a diameter disposed along the length of the tube; and the tube is open at a first end and at a second end;

an axle to couple with the tube;

a plurality of wheels disposed at a lower portion of the tube, wherein the plurality of wheels are coupled to the axle;

a securement strap located at the lower portion of the tube perpendicular to the second end of the tube, wherein the securement strap is to secure the second end of the tube;

a pair of collapsible legs coupled to the tube by securement structures, wherein the pair of collapsible legs can be moved to an extended position that is perpendicular to the tube; and an artificial tree, the artificial tree further comprising:

a central pole;

a stand having collapsible legs extending from it disposed at an end of the central pole and having a width; and a plurality of branches extending outwardly from the central pole at an angle, the plurality of branches being upwardly collapsible along the central pole;

wherein the tree is inserted into the tube when the plurality of branches are collapsed.

2. The system of claim 1, further comprising an integrally formed channel, wherein:

the integrally formed channel is disposed at a lower end of the tube; and the axle couples with the tube at the integrally formed channel.

3. The system of claim 2, wherein the tube and channel are unitary structures formed by rotational molding.

4. The system of claim 1 wherein the plurality of wheels comprises a pair of opposing tri-lobe wheels.

5. The system of claim 1, wherein:

the securement strap includes a first end and a second end;

the first end of the securement strap is permanently coupled to the tube; and the second end of the securement strap is removably coupled to the tube.

6. An apparatus for transporting and storing an artificial tree, the apparatus comprising:

a tube having a diameter disposed along the length of the tube;

an axle to couple to the tube;

a plurality of wheels disposed at a lower portion of the tube, wherein the plurality of wheels are coupled to the axle; and a pair of collapsible legs coupled to the tube by securement structures, wherein the pair of collapsible legs can be moved to an extended position that is perpendicular to the tube.

7. The apparatus of claim 6, wherein the tube is open at a first end and a second end.

8. The apparatus of claim 7, wherein the apparatus further comprises a securement strap located at the lower portion of the tube, wherein the securement strap is to secure the second end of the tube.

9. The apparatus of claim 8, wherein:

the securement strap includes a first end and a second end;

the first end of the securement strap is permanently coupled to the tube; and the second end of the securement strap is removably coupled to the tube.

10. The apparatus of claim 6, further comprising an integrally formed channel, wherein:

the integrally formed channel is disposed at a lower end of the tube; and the axle couples with the tube at the integrally formed channel.

11. The apparatus of claim 10, wherein the tube and channel are unitary structures formed by rotational molding.

12. The apparatus of claim 6, wherein the plurality of wheels comprises a pair of opposing tri-lobe wheels.

* * * * *